US008931666B2

(12) United States Patent
Holliday

(10) Patent No.: US 8,931,666 B2
(45) Date of Patent: Jan. 13, 2015

(54) FUEL DISPENSER

(75) Inventor: Antony James Holliday, York (GB)

(73) Assignee: Cordex Instruments Limited, Middlesbrough, Cleveland (GB)

( * ) Notice: Subject to any disclaimer, the term of this patent is extended or adjusted under 35 U.S.C. 154(b) by 135 days.

(21) Appl. No.: 13/487,335

(22) Filed: Jun. 4, 2012

(65) Prior Publication Data

US 2013/0075421 A1 Mar. 28, 2013

(30) Foreign Application Priority Data

Jun. 3, 2011 (GB) ..... 1109354.9
Nov. 22, 2011 (GB) ..... 1120144.9

(51) Int. Cl.

| | |
|---|---|
| ***B67D 7/70*** | (2010.01) |
| ***B67D 7/76*** | (2010.01) |
| ***B65D 83/00*** | (2006.01) |
| ***B67D 7/32*** | (2010.01) |
| ***B67D 7/36*** | (2010.01) |
| ***B67D 7/74*** | (2010.01) |

(52) U.S. Cl.

CPC ..... *B65D 83/0044* (2013.01); *B67D 7/32* (2013.01); *B67D 7/36* (2013.01); *B67D 7/741* (2013.01)

USPC ..... 222/135; 222/189.01

(58) Field of Classification Search

CPC .. B05B 11/3084; B65D 83/68; B65D 81/325; B65D 25/385; B65D 45/025; B65D 83/0044; B67D 7/32; B67D 7/36; B67D 7/741

USPC ..... 222/135, 189.01, 253

See application file for complete search history.

(56) References Cited

U.S. PATENT DOCUMENTS

| | | | | | |
|---|---|---|---|---|---|
| 2,810,495 | A | * | 10/1957 | Auguste et al. | 222/1 |
| 3,642,175 | A | * | 2/1972 | Robbins | 222/135 |
| 3,933,444 | A | * | 1/1976 | Kilgore | 48/192 |
| 4,262,710 | A | * | 4/1981 | Nomura et al. | 141/98 |
| 4,673,296 | A | * | 6/1987 | Sjogren | 366/159.1 |
| 4,877,114 | A | | 10/1989 | Taylor | |
| 5,564,608 | A | * | 10/1996 | Cooper | 222/470 |
| 5,657,511 | A | | 8/1997 | Lan | |

(Continued)

FOREIGN PATENT DOCUMENTS

| | | |
|---|---|---|
| EP | 0302583 A2 | 2/1989 |
| GB | 1139561 | 1/1969 |

(Continued)

*Primary Examiner* — Paul R. Durand
*Assistant Examiner* — Vishal Pancholi
(74) *Attorney, Agent, or Firm* — Winstead PC

(57) ABSTRACT

A fuel dispenser includes first and second cylinders adapted to contain respective first and second fluids, one being fuel and the other being a fuel additive such as a lubricant. First and second pistons in the cylinders displace the fluids through outlets and into a mixing line. The dispenser typically allows the volume of fluids displaced from each cylinder to be accurately controlled and adjusted in order to change the ratios. This is achieved by an adjustable aperture adapted to be opened and closed and optionally varied in degree of opening, typically by rotation of at least one of the components, to release fluid contained in the cylinder in front of the piston without passing the fluid into a mixing line. The adjustable aperture includes an aperture in a piston head, allowing the fluid in front of the piston to pass into or through the piston.

17 Claims, 8 Drawing Sheets

(56) References Cited

U.S. PATENT DOCUMENTS

| | | | | |
|---|---|---|---|---|
| 6,845,882 | B2 * | 1/2005 | Todd | 222/26 |
| 7,152,764 | B2 * | 12/2006 | Mack, Jr. | 222/472 |
| 7,481,335 | B2 * | 1/2009 | Owens | 222/144.5 |
| 7,891,524 | B1 | 2/2011 | Johnson et al. | |
| 2006/0278658 | A1 | 12/2006 | Nisbet | |
| 2006/0283676 | A1 | 12/2006 | Deferme | |
| 2007/0194053 | A1 * | 8/2007 | Ophardt | 222/189.01 |
| 2010/0038362 | A1 * | 2/2010 | Sasaki et al. | 220/88.3 |

FOREIGN PATENT DOCUMENTS

| | | |
|---|---|---|
| GB | 1314103 | 4/1973 |
| WO | WO-01/63140 A1 | 8/2001 |

* cited by examiner

FUEL DISPENSER

BACKGROUND TO THE INVENTION

Fuel dispensers such as jerry cans have been used for many years as a convenient and safe way to transport fluids, especially fuel. There are many designs now available including cans with and without spouts, cans made of metal and others made of plastic. Jerry cans and other designs of fuel container are commonly used to transport petrol, diesel or gasoline.

One common type of internal combustion engine is the reciprocating two stroke engine. Many small petrol driven, hand-held devices such as chainsaws and hedge trimmers and outboard engines for boats use two stroke engines.

Unlike a typical four stroke engine, these and certain other engines cannot be lubricated using oil stored in the crankcase and sump, because the crankcase is used to pump a fuel/air mix into the cylinder. The moving parts of two-stroke and other similar engines are therefore commonly lubricated by oil that has been added to the fuel. The moving parts include the crankshaft and piston. The fuel and oil can be mixed in the fuel tank or premixed to improve the homogeneity of the mixture. The ratio of fuel to oil required depends on the type of engine. A chainsaw engine is unlikely to require the same ratio of fuel to oil as, for example a hedge trimmer. It is possible to use the incorrect fuel to oil mix and it is at least inconvenient to check and mix oil into the fuel at the correct concentration/ratio.

Traditionally oil is added to the fuel tank before filling the tank with fuel (petrol in most cases). The subsequent addition of fuel helps to mix the oil and fuel, but it can be difficult to obtain a homogeneous mixture. It is also known to use a particular type of dispenser with a metered neck. These dispensers are filled with fuel and then topped up with the required amount of oil. The can/bottle is then shaken to ensure a homogeneous mix. Once the oil and fuel have been mixed, it is difficult to change the concentration of oil in the fuel if the wrong amount of oil has been added or a different concentration of oil in the fuel is required.

SUMMARY OF THE INVENTION

According to a first aspect of the present invention there is provided a fuel dispenser including:

- a first and a second cylinder adapted to contain respective first and second fluids;
- a first and a second piston, the first piston being moveable in the first cylinder and the second piston being moveable in the second cylinder;
- a mixing line in fluid communication with the first cylinder and the second cylinder; and
- a flashback arrestor;
- wherein actuation of the dispenser causes fluid from the first cylinder and fluid from the second cylinder to mix in the mixing line in a proportion of at least 2:1.

It is an advantage of certain embodiments of the present invention that fluids are displaced from the first and second cylinders into the mixing line for delivery to, for example, a storage tank or directly into a power tool, for example a chainsaw, typically using a displacement device such as a displacement pump. Using a displacement device typically allows the volume of fluids displaced from each cylinder to be accurately controlled.

The dispenser may further include a container. The container may be in fluid communication with the mixing line, typically downstream of the mixing line. The container may be part of the dispenser or a separate and removable component of a device including the dispenser and container.

The dispenser can have more than one flashback arrestor.

The flashback arrestor can optionally be provided in the mixing line.

In some embodiments, the flashback arrestor can optionally be provided in other locations in the dispenser. For example, in certain embodiments, the flashback arrestor can be provided in the container, or in a conduit providing the fluid communication between the first or second cylinder and the mixing line. In certain embodiments a respective flashback arrestor can be provided in more than one of these locations.

The first and/or second piston may have a connecting rod attached to it. The connecting rod attached to the first piston may extend from the first piston through a first end of the first cylinder; the connecting rod attached to the second piston may extend from the second piston through a first end of the second cylinder. The first end of the first and/or second cylinder may be open or alternatively it may be partially or substantially partially closed with an opening for the connecting rod.

The dispenser may include a first and a second supply line. The first supply line may be connected to a second end of the first cylinder and may provide fluid communication between the first cylinder and the mixing line. The second supply line may be connected to a second end of the second cylinder and may provide fluid communication between the second cylinder and the mixing line. The second end of the first and/or second cylinder may be substantially partially closed.

The first piston may be moveable in the first cylinder to displace (e.g. push) fluid contained in the first cylinder into the first supply line and then into the mixing line; the second piston may be moveable in the second cylinder to push fluid contained in the second cylinder into the second supply line and then into the mixing line.

The dispenser may include an actuator such as a handle or a pedal. The actuator may be attached to the first piston and/or the second piston, normally via the respective connecting rods. The actuator may be movable to simultaneously move the first piston in the first cylinder and the second piston in the second cylinder.

The actuator may be a lever. The lever may comprise a rigid arm that can move about a pivot point or fulcrum. The lever may be attached to the connecting rods with a gearing mechanism. The actuator may be a pump. The pump may be hand and/or foot operated. The pump may push air or another fluid into the first and/or second cylinder to urge the pistons to move through the first and/or second cylinder. The pump may push both the first and second pistons through the corresponding first and second cylinders at the same speed. The pump may be a two-way pump and therefore on one stroke be able to push air into the first and/or second cylinder and on another stroke pull fluid into the first and/or second cylinder from at least one holding tank. The two-way pump may have a valve for selecting or reversing the push or pull action of the pump.

The dispenser may be hand-held when it is used to dispense fluids.

The flashback arrestor may reduce and typically stop the possibility of a flame from burning back through the mixing line or the conduit into the first and/or second cylinder of the dispenser, thereby mitigating the risk of an explosion and/or fire. The flashback arrestor may reduce and typically stop the possibility of a flame burning into the container. The flashback arrestor can optionally disrupt flow of fluids, such as air and fuel, through the mixing line thereby disrupting any flames passing into the mixing line.

The flashback arrestor may comprise a metal such as brass.

The flashback arrestor may comprise a strainer; the strainer may include a filter.

Each piston may be configured to simultaneously move towards the second end of the respective cylinder.

The dispenser may include a non-return valve. The non-return valve may be disposed between the cylinders and the mixing line. The non-return valve may prevent or substantially prevent fluid from moving along the mixing line towards the first and/or second cylinders. There may be more than one non-return valve. The said valve (or valves) may be operable to simultaneously open fluid communication between the mixing line and each cylinder. Opening of the valve (or valves) may be during simultaneous movement of the pistons, towards the second end.

The fluid in the first and/or second cylinder may be a liquid. In use, the invention provides a dispenser as described herein, and may be used for dispensing a mixture of fuel (especially a hydrocarbon fuel such as petrol, diesel or gasoline) and oil. In an alternative embodiment the oil may be an additive. The additive may have one or more of the following functions: increasing the octane rating of the fuel; lubrication; and reducing corrosion of materials in contact with the fuel.

Normally the cylinders can draw fluid from respective separate holding tanks.

The dispenser may include a valve to prevent mixing of fluids during filling of the cylinders, and the valve can typically be provided at one end of the mixing line. In use the valve can be placed in the connecting aperture between the mixing line and a tank that will receive fluid from the mixing line. The valve may include a flap or a wedge device as a valve closure member, which can typically pivot about a pivot point to open and close the valve. The flap or wedge device is typically moveable with respect to the outlet of the mixing line to affect the flow of fluid from the mixing line and/or reduce contamination of the mixing line with contaminants from the surrounding environment. There may optionally be a spring device disposed between the flap and the valve closure member, the spring typically acting to bias the flap or wedge device into a closed configuration, wherein the flap or wedge device substantially restricts or closes the end of the mixing line.

The inventor of the present invention has appreciated that, without wanting to be bound by theory, the flow dynamics of the fluids in the first and second cylinders affects the accuracy with which the fluids can be dispensed from the cylinders. The inventor has also appreciated that the header pressure of the liquids in the cylinders above the mixing line also affects the accuracy with which the fluids can be dispensed from the cylinders. When dispensing fluids from the dispenser it is therefore advantageous that the first piston is moveable down through the first cylinder and the second piston is moveable down through the second cylinder.

The mixing line is optionally positioned below the first and second cylinders. The relative positions of the mixing line and first and second cylinders are typically important for the accuracy with which the fluids can be dispensed from the cylinders. If the mixing line is above the first and second cylinders this can affect the head pressure of the fluids in the cylinders and therefore the accuracy with which the fluids are dispensed.

The first and/or second cylinder may include a spring to push the pistons through the respective cylinder and thereby push fluid in the first and/or second cylinder into the mixing line. Using a spring in the first and/or second cylinder causes fluid to flow from the mixing line whenever the flap is moved away from the end of the mixing line.

The dispenser may include at least one seal such as an o-ring between the first piston and the first cylinder to provide a substantially fluid tight seal between the first piston and a wall of the first cylinder, to thereby contain the fluid within the cylinder, between the piston head and the outlet. There may, in a similar manner, be at least one such seal between the second piston and the second cylinder.

The first and/or second cylinder may include a valve to provide fluid communication between an inside of the cylinder and the environment around the dispenser. The valve may be an air bleed valve and may be behind the piston.

The volume of the first cylinder may be greater than the volume of the second cylinder. The volume of the first cylinder may be at least twice the volume of the second cylinder.

Thus in one series of embodiments the at least 2:1 proportion of fluid from the first cylinder to fluid from the second cylinder is provided, at least in part, by a difference in the volume of the first cylinder compared to the volume of the second cylinder.

The volume of the first and/or second cylinder typically depends on the internal diameter of the cylinder. The internal diameter of the second cylinder may be used to affect the ratio of fluid dispensed from the first cylinder relative to the second cylinder.

The volume or nominal capacity of the first cylinder may be between 3 and 5 L, normally 4 L. The volume or nominal capacity of the second cylinder may be between 0.15 and 0.35 L, normally 0.25 L. The first and/or second cylinder may have sufficient volume to accept 105% of the nominal capacity. The second cylinder may have sufficient volume to accept approximately twice the nominal capacity.

Alternatively the volume or nominal capacity of the first cylinder may be between 2 and 5 L, normally 3 L. The volume or nominal capacity of the second cylinder may be between 0.03 and 0.08 L, normally 0.06 L.

The first cylinder may have an internal diameter of between 100 and 160 mm, normally between 120 and 140 mm, typically 130 mm. The length of the first cylinder may be between 300 and 330 mm, normally between 315 and 320 mm, typically 317 mm.

Alternatively the first cylinder may have an internal diameter of between 100 and 300 mm, normally between 180 and 210 m, typically 195 mm. The length of the first cylinder may be between 50 and 150 mm, normally between 90 and 110 mm, typically 100 mm.

The internal diameter of the second cylinder may be between 1 and 50 mm, normally between 10 and 40 mm, typically between 32 and 33 mm, optionally 32.5 mm. The length of the second cylinder may be between 300 and 330 mm, normally between 315 and 320 mm, typically 317 mm.

Alternatively, the internal diameter of the second cylinder may be between 1 and 50 mm, normally between 10 and 40 mm, typically between 25 and 33 mm, optionally 27.5 mm. The length of the second cylinder may be between 50 and 150 mm, normally between 90 and 110 mm, typically 100 mm.

The ratio of the volume of the first and second cylinders may be between 150 and 5:1, typically 115 and 10:1, normally between 100 and 15:1, for example 16:1; 20:1; 25:1; 32:1; 40:1; 50:1; or 100:1. Thus in use, between 1 and 5% of the fluid in the mixing line may be from the second cylinder. The internal diameter of the second cylinder may correspond to the above ratios of fluids and may be 32.5; 29.1; 26.0; 23.0; 20.6; 18.4; and 13.0 mm.

The second cylinder of the dispenser may be interchangeable with other similar cylinders having the same or different volumes. The ratio of fluid introduced into the mixing line from the first and second cylinders may be fixed or may be changeable.

The dispenser may be configured such that the speed at which the first piston moves through the first cylinder may be greater than the speed at which the second piston moved through the second cylinder.

Thus, in another series of embodiments the at least 2:1 proportion of fluid from the first cylinder to fluid from the second cylinder is provided, at least in part, by a difference in the speed at which the first piston moves through the first cylinder compared to the speed at which the second piston moves though the second piston.

The dispenser may be arranged such that the speed at which the second cylinder is moveable through the second cylinder may be used to affect the ratio of fluid dispensed from the first cylinder relative to the second cylinder. The speed of the first cylinder relative to the second cylinder may be 1; 1.25; 1.56; 2; 2.5; 3.13; and 6.25 when the speed of the second cylinder is 1. The speed of the first cylinder relative to the second cylinder may be affected by a cam mechanism.

In yet another series of embodiments the at least 2:1 proportion of fluid from the first cylinder to fluid from the second cylinder is provided, at least in part, by provision of at least one aperture allowing fluid to pass through the piston, or otherwise providing a fluid conduit allowing fluid to pass around the first and/or second piston.

At least one of the pistons, and optionally both of them may have an adjustable aperture adapted to be opened and closed and optionally varied in degree of opening, typically by rotation of at least one of the components, to release fluid contained the cylinder in front of the piston without passing the fluid into the mixing line. In certain embodiments, the adjustable aperture can comprise an aperture in the piston head, allowing the fluid in front of the piston (i.e. the fluid contained in the cylinder between the piston and the outlet) to pass into or through the piston.

Optionally, at least one of the pistons (e.g. optionally the oil piston) can have first and second piston heads. The piston heads may be rotatable relative to one another, especially to vary the degree of fluid communication through the first and/or second piston. The piston heads can optionally be arranged in different planes. Typically the first and second piston heads are arranged parallel to one another, typically on top of one another. It is an advantage of certain embodiments of the present invention that the volume of fluid that can pass through the first and/or second piston can be controlled by adjusting the relative positions of the apertures in the first and second piston heads.

The first and second piston heads may be rotatable with respect to each other. Thus in use, rotation of the piston heads with respect to each other can vary the alignment of said aperture in at least one of the heads, with an aperture or blocking portion on the other piston head. At least one piston head may have two or more apertures, the apertures may form a series of apertures increasing or decreasing in cross sectional area through the series. Thus rotation in use can align or misalign the respective apertures with each other, increasing or decreasing the cross-sectional area of the flow paths in order to control the degree of fluid communication into or through the piston.

The apertures may be of various shapes, e.g. circular or crescent shaped.

The piston head may be a face of the piston. The piston head may be used to push the fluid from the cylinder.

A piston with at least one aperture through or around it can be useful for other embodiments of the present invention, accordingly this invention also provides a piston, the piston having at least one piston head with at least one aperture therein to provide fluid communication through the piston.

A piston according to the second aspect of the present invention may be the first and/or second piston of the first aspect of the present invention.

The at least 2:1 proportion of fluid from the first cylinder to fluid from the second cylinder may be provided by a combination of two or more of the first, second and third series of embodiments, for example the speed of the piston and volume of the cylinder. The at least 2:1 proportion of fluid from the first cylinder to fluid from the second cylinder may alternatively be provided by the area of the face of the piston head.

The optional features of the first aspect of the present invention can be incorporated into the second aspect of the present invention and vice versa.

According to a third aspect of the present invention there is provided a method of dispensing at least two fluids from at least two cylinders respectively, the method including the steps of:

- providing a dispenser according to the first aspect of the present invention;
- filing first and second cylinders of the dispenser with first and second fluids respectively;
- moving a first piston in the first cylinder and a second piston in the second cylinder to move fluid from the cylinders into a mixing line; and
- mixing the fluids in the mixing line.

It is an advantage of certain embodiments of the present invention that the fluids in the first and second cylinders are transferred using positive displacement and that the relative ratio of the fluids can be controlled by the user of the dispenser and therefore tailored to specific requirements. As these requirements change, the ratio of the fluids can be quickly and easily changed. The positive displacement may instead be displacement.

The method may include the step of dispensing a mixture of the at least two fluids from the dispenser. The first cylinder may contain petrol; the second cylinder may contain oil. Alternatively, the first cylinder may contain oil; the second cylinder may contain petrol.

The method may include selecting a second cylinder with a predetermined internal diameter to affect the ratio of the first and second fluids mixed in the mixing line.

The method may further or alternatively include altering the speed at which the second piston moves through the second cylinder relative to the speed the first piston moves through the first cylinder.

Alternatively or in addition, the first and/or second piston has at least one aperture such that as it is moved through the first and/or second cylinder, at least some of the fluid in the first and/or second cylinder is able to pass through at least one of the apertures in the first and/or second piston.

The dispenser according to the first aspect of the present invention may include a piston according to the second aspect of the present invention. The piston may have first and second piston heads. The method may include the step of rotating a piston head relative to another to vary the degree of fluid communication through the piston.

The optional features of the third aspect of the present invention can be incorporated into the first and/or second aspect of the invention and vice versa.

BRIEF DESCRIPTION OF DRAWINGS OF EMBODIMENTS OF THE INVENTION

Embodiments of the present invention will now be described, by way of example only, with reference to the accompanying drawings, in which.

Figure 12:
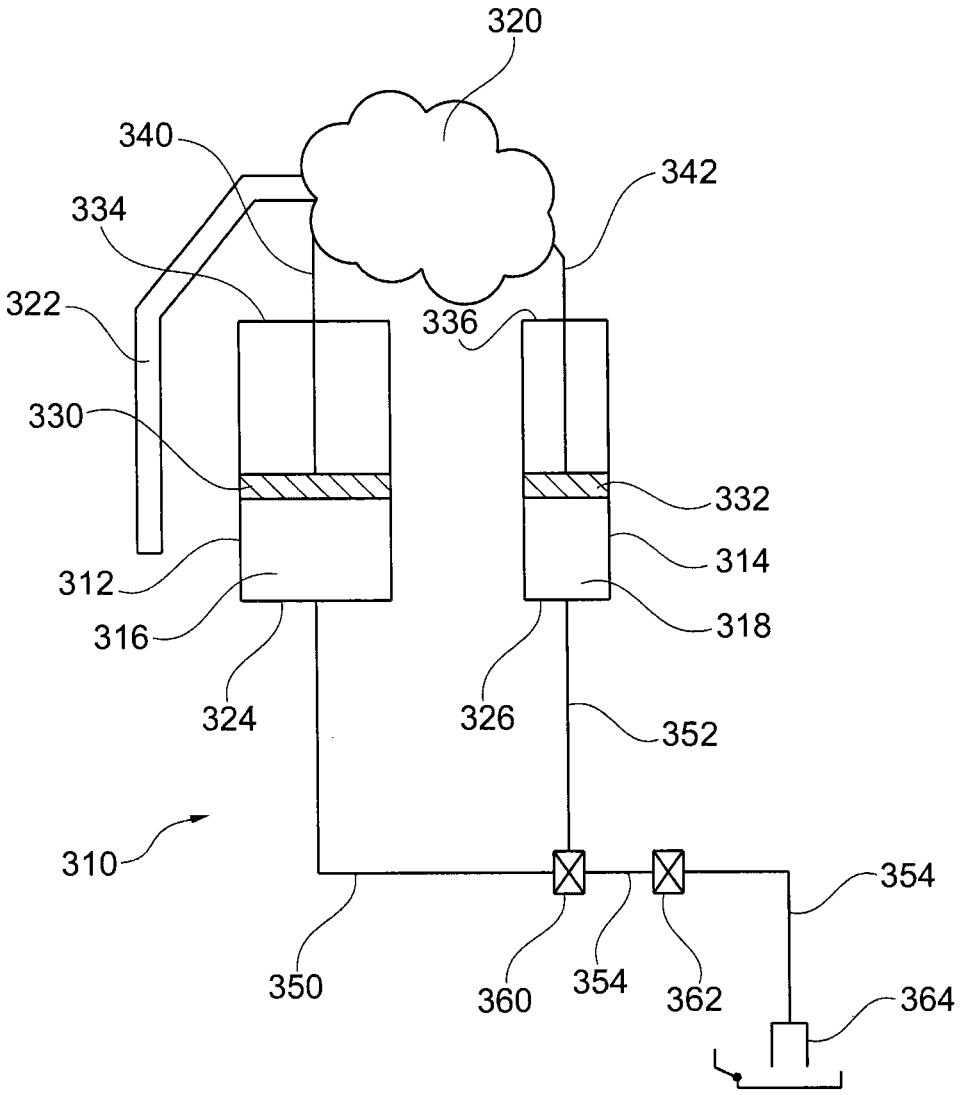
Figure 13:
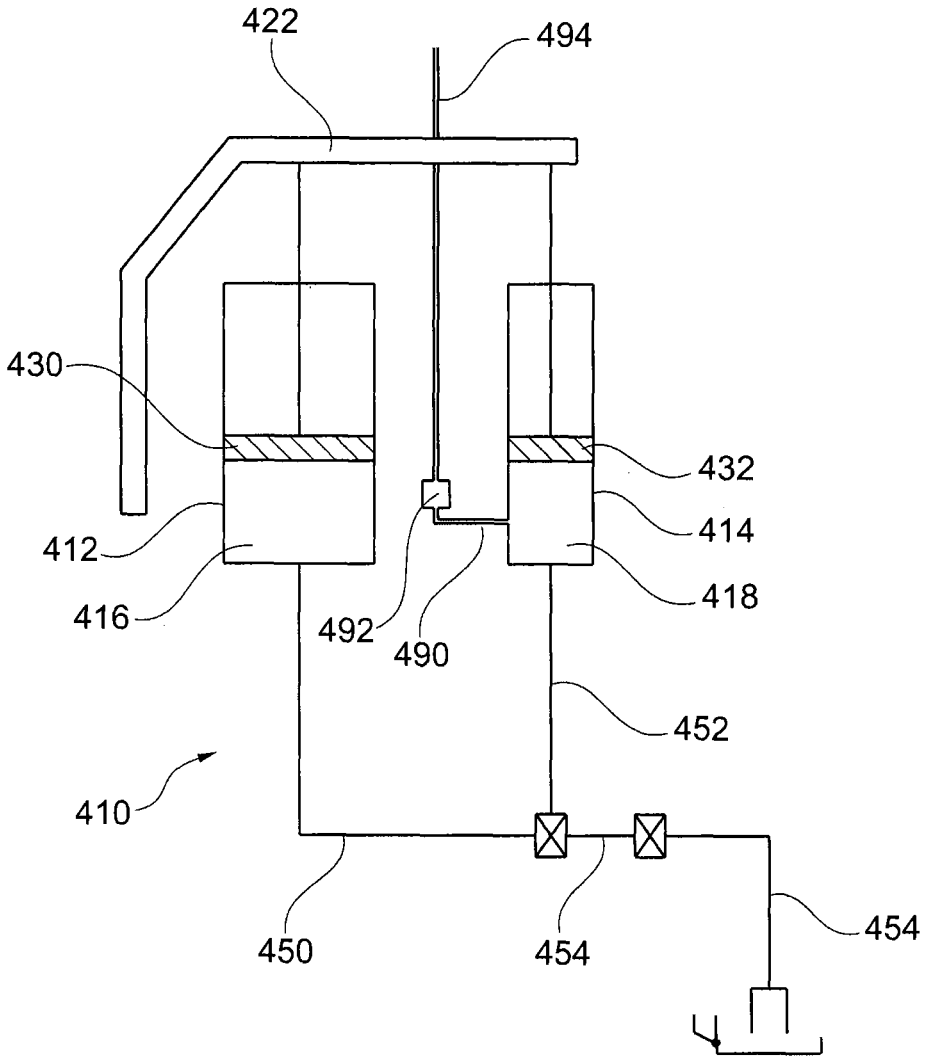

FIG. 12 is a cross-sectional view of a fluid delivery system according to a third embodiment of the present invention, including two cylinders having different internal diameters and a cam mechanism to advance the pistons in the cylinders; and FIG. 13 is a cross-sectional view of a fluid delivery system according to a fourth embodiment of the present invention, including two cylinders having different internal diameters and a return flow line with flow control device therein.

DETAILED DESCRIPTION OF THE INVENTION

A dispenser 10 according to a first embodiment of the invention is shown in FIGS. 1-7, and is typically able to deliver petrol 16 and oil 18 at a fixed and/or variable ratio. The dispenser 10 typically has a first cylinder 12 containing a fuel such as petrol 16 and a second 14 cylinder containing an additive such as oil 18. The volume of petrol 16 dispensed from the first cylinder 12 is typically greater than the volume of oil 18 dispensed from the second cylinder 14. Optionally the internal diameter of the cylinder 14 can be smaller than the internal diameter of the first cylinder 12. The second cylinder 14 is optionally interchangeable with other cylinders (not shown) having different volumes.

At least one piston 32 of the pair typically has two piston heads. As will be described below, the volume of oil 18 dispensed from the second cylinder 14 is less than the volume of petrol 16 dispensed from the first cylinder 12. Some of the oil 18 in the second cylinder 14 is able to pass through apertures 74, 76*a* in the piston 32. It is an advantage of the present invention that the petrol and oil is displaced from the first and second cylinders respectively. This means the volumes of petrol and oil dispensed can be accurately metered and/or controlled. Accurate delivery of petrol and oil is independent of the orientation of the cylinders and total volume of petrol and oil in the cylinders. The dispenser 10 can be used to dispense petrol and oil in various ratios, the ratio can be set by the user or can be predefined during manufacture of the dispenser 10.

The fluids contained in the cylinders are generally contained in front of the cylinders, typically in the lower part of the cylinder as shown in the drawings, but embodiments of the invention can be made with the fluid contained in upper parts of the cylinder, and the orientation of the cylinder is not significant. Accordingly, references in this description to "upper" and "lower" and similar terms are not intended to be limiting to the scope of the invention. The fluid is contained between the lower wall of the cylinder and a movable piston 30, 32. The pistons are typically movable axially within the bores of the cylinders 12, 14, and are typically radially sealed to the side wall of respective cylinders 12, 14, so that the axial movement of the pistons in the bores of the cylinders controls the pressure in the fluid in front of the pistons 30, 32, and therefore also controls the rate flow of fluid from the outlets of the cylinders, typically located in the lower end walls of the respective cylinders (furthest from pistons).

The pistons 30, 32 can be actuated to move axially up and down in the cylinders 12, 14 by various different mechanisms. Typically the pistons 30, 32 have respective connecting rods 40, 42 connecting the upper face of the pistons 30, 32 with the actuating mechanism typically located above the cylinders. In the first embodiment shown in FIG. 1, the connecting rods 40, 42 are optionally activated by a handle or lever 22 adapted to be operated by hand or by foot, and the connecting rods 40, 42 typically extend from the pistons 30, 32 through the upper ends 34, 36 of the first and second cylinders 12, 14 respectively for connection to the lever, either directly, or via a pivot connection, if the lever has a fulcrum.

A first supply line 50 is connected to the outlet of the cylinder 12 at the lower end 24 of the first cylinder 12, providing fluid communication for the petrol 16 between the first cylinder 12 and a mixing line 54. A second supply line 52 is typically attached to a second end 26 of the second cylinder 14. Like first supply line 50, second supply line 52 also provides fluid communication for the oil 18 between the second cylinder 14 and the mixing line 54.

A non-return valve 60 typically connects together the first supply line 50 and second supply line 52. There is typically an air bleed valve 62 in the mixing line 54, between the non-return valve 60 and a flashback arrestor 64. The flashback (or flash) arrestor 64 is connected to a spring loaded self-sealing cap 68, the cap 68 is pivotable about pivot 66.

The petrol 16 and oil 18 are typically dispensed in liquid phase, and can flow through the outlets of the cylinders into the various fluid conduits in response to pressure increases in the cylinders, typically reacting to the axial (e.g. downward) movement of the control rods when the dispenser is actuated. The fluids are typically fuels, optionally mixed with an additive, and embodiments of the invention can be used to dispense diesel, biodiesel, an additive to increase the octane rating of the fuel, and fuel treatments.

The first piston 30 is movable in the first cylinder 12; the second piston 32 is moveable in the second cylinder 32. Moving the first piston 30 through the first cylinder 12 towards the outlet increases the internal pressure in the cylinder and expels the petrol 16 from the outlet of the first cylinder 12 and into the supply line 50; moving the second piston 32 through the second cylinder 14 towards the outlet of the second cylinder displaces the oil 18 out of the second cylinder 14 and into the supply line 52 at the same time.

Typically at least one of the pistons, e.g. the second piston 32, has an adjustable aperture to control the pressure in the fluid being delivered into the mixing line 54. Typically at least one of the pistons, e.g. the second piston 32, has first 70 and second 72 piston heads. Each piston head 70, 72 has a respective aperture 74, 76*a* arranged at the same radial position in the respective heads 70, 72, but the apertures on the respective piston heads 70, 72 can be moved in and out of register with one another, typically by relative movement e.g. by relative rotation of the heads. The second piston head 72 is typically rotatable relative to the first piston head 70, by rotating the connecting rod 42. The connecting rod 42 can typically be rotated from outside the second cylinder 14.

Figure 7:
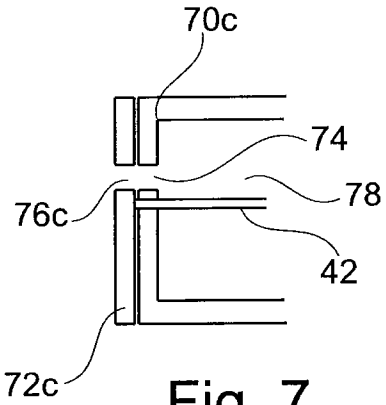
FIGS. 5 to 7 are cross-sectional views of the piston heads according to the first embodiment of the present invention.
Figure 3:
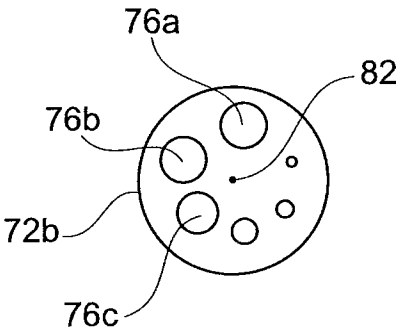

Although pistons with a single aperture are within the scope of the invention, the second piston head 72 typically has more than one aperture, typically arranged in a series of apertures 76*a* of various diameters (as shown in FIG. 3) typically disposed in generally the same radial position (i.e. centered at the same distance away from the center of the head) but in different circumferential positions around the head 72. The first piston head 70 typically has a single aperture 74 (as shown in FIG. 7, although more than one aperture could be provided), typically located in the same radial position (i.e. the same distance from the central connecting rod 42) as the series of apertures 76*a*, and typically larger than the largest of the apertures 76*a* in the series. The series of apertures 76*a* is typically graduated in size, and gradually increase in cross-sectional area as the series extends around the circumference of the head 72. The series of apertures in the head 72 typically does not extend around the whole circumference of the head 72, and there is typically at least one un-apertured portion or blanked portion which, when aligned with the single aperture 74 in the head 70, closes the aperture 74 and does not permit (or at least partially restricts) the free passage of fluid through the heads 70, 72. However, when the aperture 74 is rotationally aligned with any of the series of apertures 76*a*, the aligned apertures 74, 76*a* provide a conduit through the heads 70, 72, allowing the venting of fluid out of the volume of pressurized fluid contained in front of the piston. The amount of fluid able to flow through the heads 70, 72 is typically limited by the cross-sectional area of the particular aperture 76*a* in the series that is rotationally aligned with the aperture 74, because the aperture 74 is usually larger than the apertures 76*a*. The larger the diameter of the aperture 76*a*, the higher the flow rate of the fluid through the heads 70, 72.

In operation, as the second piston 32 is moved through the second cylinder 14, the pressure in the oil contained between the piston 32 and the outlet of the cylinder 14 increases, and if the aperture 74 is rotationally aligned with one of the apertures 76*a*, so that a conduit exists through the heads 70, 72, some of the oil 18 passes through the apertures 74, 76*a* and into a chamber 78 of the second piston head 72, which relieves the pressure applied by the piston 32 on the oil being urged into the outlet, and reduces the amount of oil being delivered to the mixing line. As the oil 18 leaks into the chamber 78, air optionally bleeds from e.g. the upper face of the chamber 78 through aperture 80 so as to prevent hydraulic locking of the chamber 78 tending to resist the in-flow of oil into the chamber 78 through the apertures 74, 76*a*.

Controlling the relative position of the piston heads 70, 72 changes the cross-sectional area of the leak pathway through the piston heads 70, 72, (from 0 to e.g. 70%) and thereby determines the relative reduction of pressure applied by the piston ratio of petrol 16 and oil 18 entering the mixing line 54, which thereby controls the ratio of the mix. Optionally the aperture 80 can comprise a valve, e.g. a one-way valve. The chamber 78 is optional.

Typically the pistons move through the cylinders at the same speed but in some modified versions of this embodiment the pistons can optionally be moved at different speeds, for example, by using a cam mechanism as described in more detail below. To further alter the relative concentrations or ratio of oil and petrol entering the mixing line in this embodiment, the cylinder 14 and piston 32 can optionally be removed and replaced with another cylinder and piston having a different (e.g. larger) internal diameter. Changing the internal diameter of the cylinder 14 changes the volume of oil 18 delivered to mixing line 54 per stroke of the piston and thereby provides a crude adjustment mechanism in certain circumstances.

In a further modification of this embodiment, as described below, at least one of the cylinders, e.g. the second cylinder 14 can have an optional return flow line venting from the fluid being displaced from the cylinder in front of the piston. The return flow line can optionally communicate with the pressurized fluid in front of the piston through e.g. the side wall of the cylinder between the piston and the outlet. The return flow line can allow some of the oil to escape from the second cylinder 14 and optionally drain to a supply tank (not shown). The amount of oil 18 entering the return flow line is typically controlled by a restrictor in the line. As the restrictor is opened, more oil leaks through the return line and the pressure in the oil being urged into the mixing line is reduced, thereby reducing the volume of oil being delivered through the outlet and into the mixing line. When the restrictor is closed, the full pressure of the oil in the cylinder is available to urge the oil through the outlet and into the mixing line.

Figure 4:
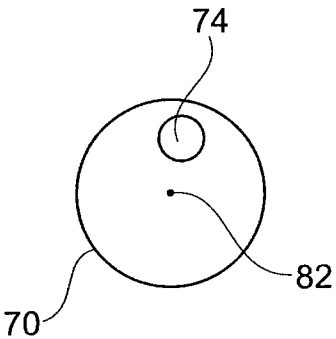
FIGS. 2 to 4 are plan views of piston heads according to the first embodiment of the present invention.
Figure 2:
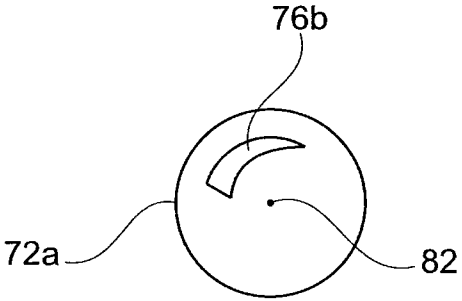

FIGS. 2 to 4 show views of alternative piston heads 72*a*, 72*b* and 70 useful for the first embodiment. The first piston head 70 has one aperture 74, the diameter of which is typically at least the same as or larger than the diameter of the largest aperture 76*a* in the second piston head 72*b*. Second piston head 72*a* has a crescent shaped aperture 76*h*. Both second piston heads 72*a*, 72*b* perform the same function. Piston heads 72*a*, 72*b* and 70 are rotatable about a central axis 82 to control the cross-sectional area of the conduit through the piston.

Figure 1:
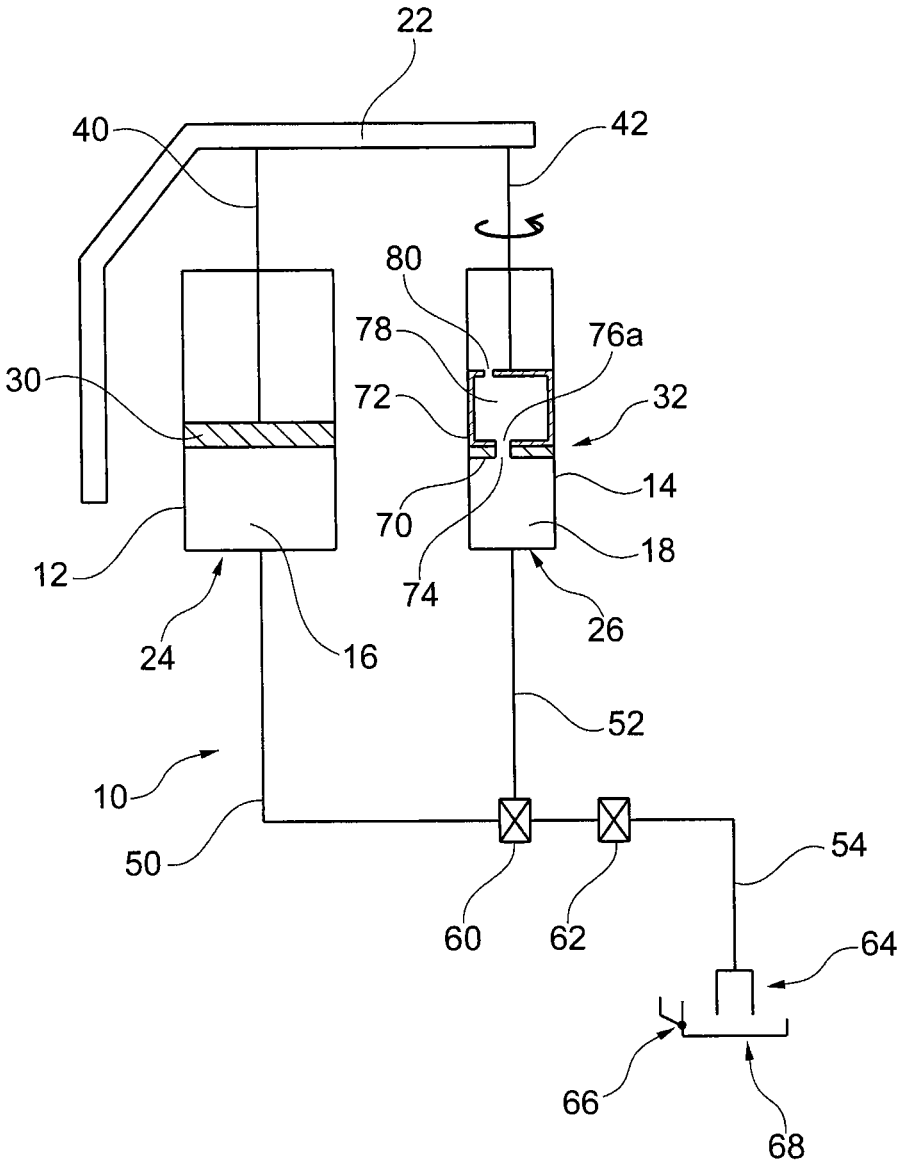
FIG. 1 is a cross-sectional view of a fluid delivery system according to a first embodiment of the present invention, including two cylinders having different internal diameters and a piston with respective apertures therein.
Figure 6:
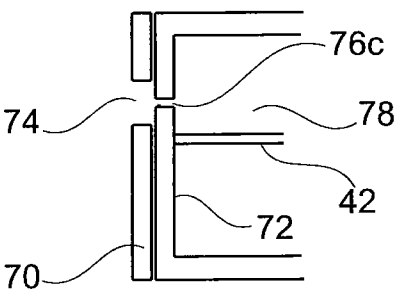
Figure 5:
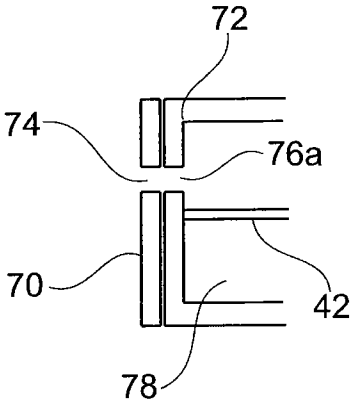

FIGS. 5 and 6 show an enlarged cross-sectional view of alternative piston heads. FIG. 1 shows the connecting rod 42 attached to the end of the chamber 78 furthest from the outlet, e.g. near the top of the chamber. In an alternative possibility and as shown in FIGS. 5 and 6, the connecting rod 42 is attached to the lower end of the chamber 78. Relative rotation of the two heads 70, 72 changes the cross-sectional area of the conduit through the piston, whichever however the piston head is attached to the rod 42. The chamber 78 can optionally be omitted in certain embodiments, leaving the oil simply to vent through the piston heads from one side of the piston to the other. Seals between the pistons heads can be included, but are not necessary. Seals between the piston heads and the cylinder side walls can be included, but some embodiments can omit them and still function with acceptable accuracy.

Figure 8:
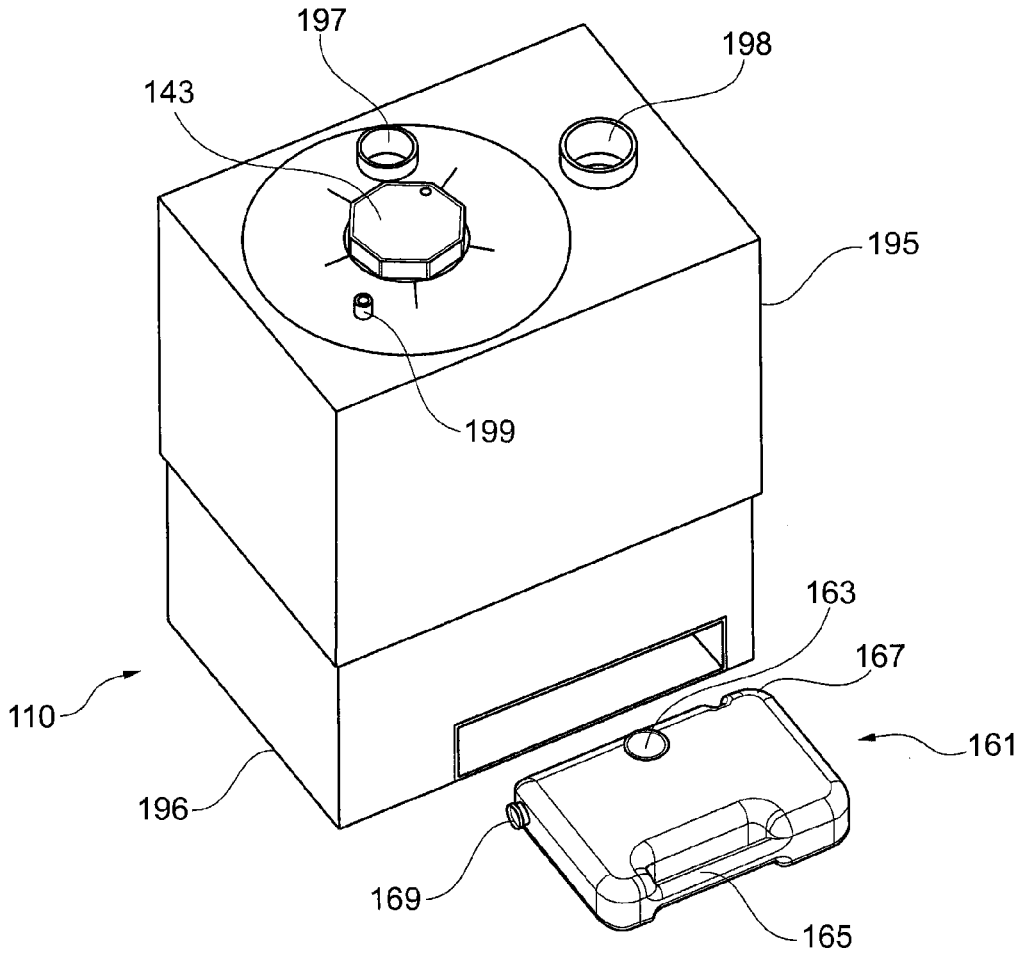
FIG. 8 is a perspective view of a fluid delivery system according to a second embodiment of the present invention.

FIG. 7 shows a further alternative arrangement of piston heads 70*c*, 72*c*. FIG. 8 shows the connecting rod 42 attached to the lower piston head 72*c* nearest the outlet, the connecting rod 42 passing through the upper piston head 70*c*. The ability to rotate the piston heads in order to change the cross-sectional areas of the conduits is unchanged.

Figure 9:
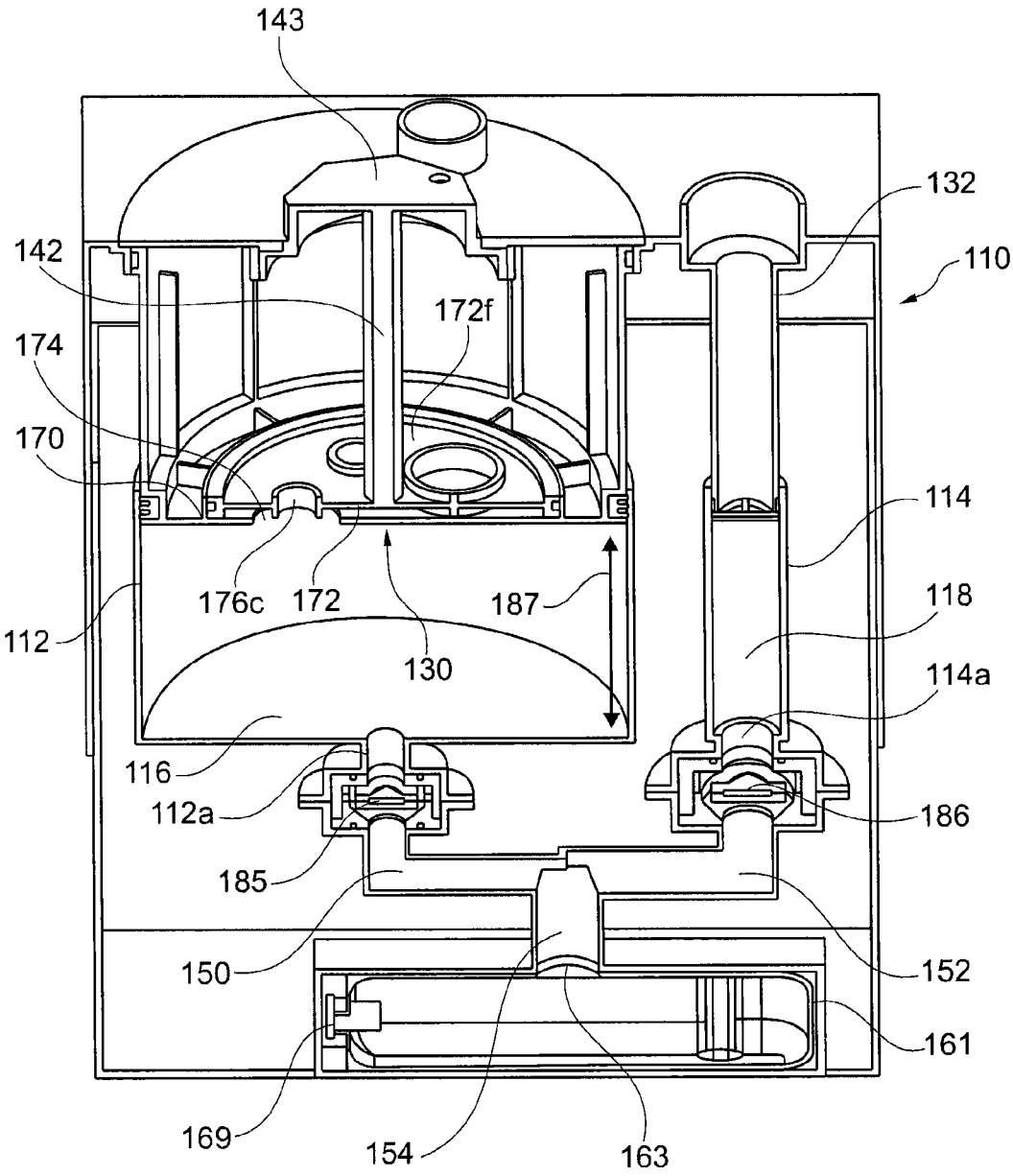
FIG. 9 is a cross-section perspective view of the fluid delivery system according to the second embodiment of the present invention.
Figure 10:
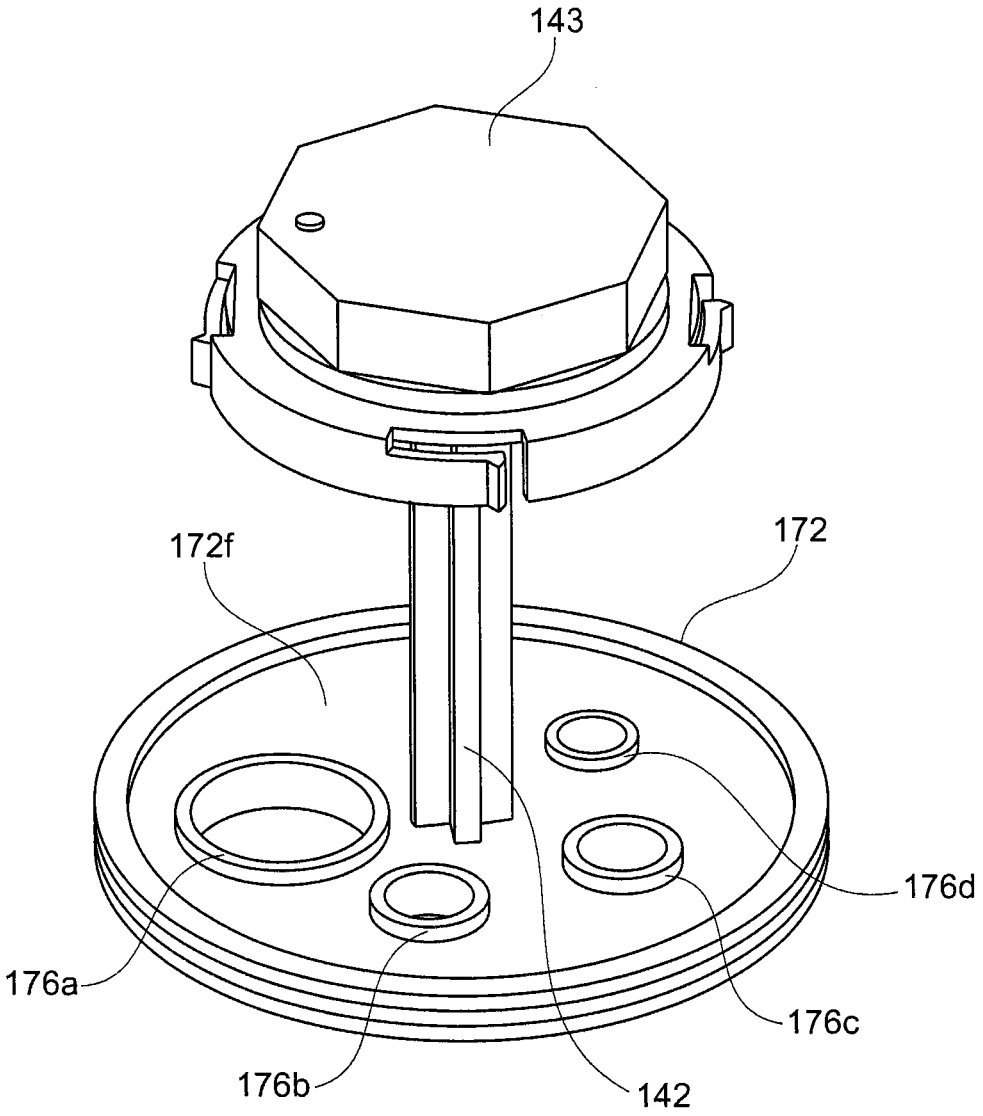
FIG. 10 is a perspective view of the second piston head and connecting rod according to the second embodiment of the present invention.

As will be described in more detail below, FIGS. 8 to 10 show a dispenser 110 or components of the dispenser 110 according to a second embodiment of the present invention. In contrast to the embodiments shown in FIGS. 1 to 4, FIG. 12 shows the first cylinder 112 having first 170 and second 172 piston heads, and wherein in use, the first cylinder 112 contains petrol 116 and second cylinder 114 contains oil 118.

FIG. 8 is a perspective view of a fluid delivery system according to the second embodiment of the present invention. FIG. 8 shows a dispenser 110 with a lid 195 and base 196. The lid 195 is equivalent to the lever 22 of the first embodiment shown in FIG. 1 and includes the first and second pistons (not shown). The base 196 includes the first and second cylinders and mixing line (not shown).

In use, the dispenser 110 is typically positioned with the base 196 on a flat, stable surface. The lid 195 is pushed down relative to the base 196. The user may apply pressure to the lid 195 using his/her hand or foot. Pushing the lid 195 down fills the cassette 161 with a mixture of fuel and oil in a variable ratio determined by the dispenser 110. The cassette 161 can be removed from the dispenser 110. The cassette 161 has an outlet port 169, the cassette having an exemplary internal volume of 1 L. The cassette 161 may have any volume but normally a volume of between 1 and 10 L, typically between 1 and 5 L. A flashback arrestor is incorporated into the outlet port 169 of the cassette 161. The flashback arrestor reduces the possibility of a flame from burning into the cassette 161. The flashback arrestor is made of brass and includes a strainer, through which the petrol and oil mix can leave the cassette but a flame cannot enter the cassette.

The cassette 161 has a handle 165 and filling port 163 that, when the cassette is in the dispenser 110, is in fluid communication with the mixing line 154 and through which the cassette is filled with a mixture of petrol and oil. The cassette 161 also includes a poke-yoke 167, a mechanical mechanism to select the ratio of fuel to oil depending on the particular cassette 161 in the dispenser 110. The poke-yoke is an interlock which prevents, for example, a cassette 161 for a 16:1 mixture of petrol to oil being inserted into the dispenser 110, when the dispenser 110 has been set to dispense a mixture of petrol to oil in a ratio of anything other than 16:1.

It is advantageous to use a mechanical rather than an electrical selection means to reduce risks from the introduction of an ignition source, and to reduce the regulatory requirements. Using only mechanical actuation mechanisms also increases the inherent safety of the device.

The lid 195 of the dispenser 110 has filing port 197 through which the user refills the dispenser with petrol and filing port 198 for oil. Port 199 is an air bleed for use when filing the dispenser with petrol.

FIG. 9 is a cross-section perspective view of the fluid delivery system according to the second embodiment of the present invention.

In use, the first cylinder 112 contains petrol 116 and has a typical diameter of 195 mm. The second cylinder 114 contains oil 118 and has a typical diameter of 27.5 mm. The outlet 112*a* of the first cylinder 112 has a typical internal diameter of 15 mm; the outlet 114*a* of the second cylinder 114 has a typical internal diameter of 20 mm.

The first cylinder 112 is connected to the first supply line 150 via a one-way valve 185. The second cylinder 114 is connected to the second supply line 152 via another one-way valve 186. In use, the one way valves 185, 186 allow the petrol 116 and oil 118 to flow from the first and second cylinders 112, 114 into the first and second supply lines 150, 152 respectively but not from the supply lines 150, 152 into the cylinders 112, 114.

The first 150 and second 152 supply lines provide fluid communication to the mixing line 154. The first 150 and second 152 supply lines have vents (not shown) so that, in use, after the first and second pistons 130, 132 have been pushed down through the cylinders 112, 114 respectively, the remaining fuel and oil in the first 150 and second 152 supply lines is released and drains out of the mixing line 154 into the cassette 161.

The first piston 130 has a travel 187 of 100 mm in the first cylinder 112. Both piston heads 170, 172 have apertures 174, 176*c*. The second piston head 172 is rotatable relative to the first piston head 170, using the connecting rod 142. Rotation of the connecting rod 142 can be affected from outside the first cylinder 112.

In use, when the face 172*f* of the second piston head 172 covers the aperture 174 in the first piston head 170, a fuel to oil ratio mix of 50:1 is produced in the mixing line 154. When aperture 176*b* is aligned with the aperture 174 the fuel to oil ratio in the mixing line 154 is 16:1, using aperture 176*c* the ratio is 20:1, using the aperture 176*d* the ratio is 25:1. Aperture 176*a* is used in a filling mode when the first cylinder is being filed with fuel.

The connecting rod 142 has a dial selector 143 at one end and the second piston head 172 at the other end. The ratio of fuel to oil can be adjusted by the user or can be or can be "factory set".

The skilled reader will appreciate that both first and second embodiments comprise a piston with first and second piston heads and apertures therein. In both embodiments control of fluid flow through the apertures is used to control the relative volume of the fluid dispensed from the cylinder. The difference is that the first embodiment describes the apertures in the second piston used to dispense the oil whilst in the second embodiment the apertures are in the first piston used to dispense the petrol.

FIG. 10 is a perspective view of the second piston head 172 connecting rod 142 and selector 143 according to the second embodiment of the present invention. The aperture 176*a* in the second piston head 172*b* has a typical inner diameter of 35 mm, aperture 176*b* has a typical inner diameter of 15.61 mm, aperture 176*c* has a typical inner diameter of 13.59 mm, aperture 176*d* has a typical inner diameter of 11.06 mm.

Figure 11:
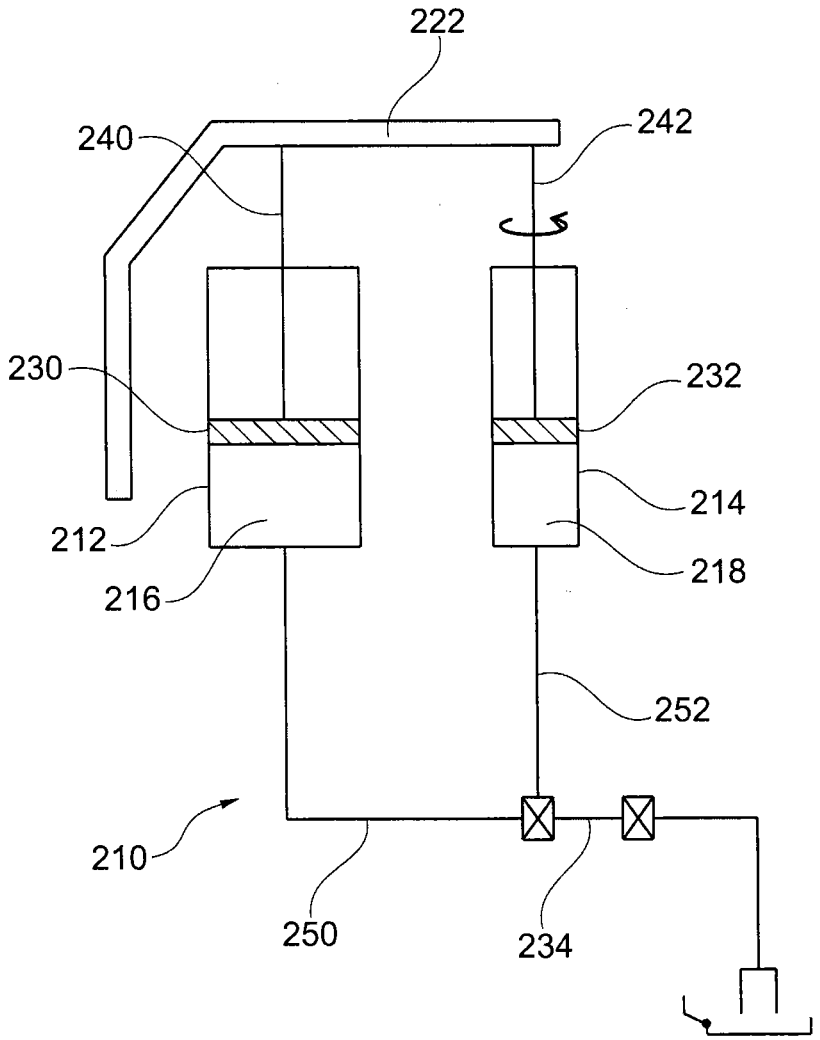
FIG. 11 is a cross-sectional view of a fluid delivery system according to a third embodiment of the present invention, including two cylinders having different internal diameters and a lever to advance the pistons in the cylinders.

A modified embodiment is shown in FIG. 11, similar to the first embodiment, and using the same reference numbers as the first embodiment, but increased by 200. Similar features to the first embodiment will not be recited in detail for brevity. The FIG. 11 dispenser 210 has a lever 222 to move the pistons 230, 232 in the cylinders 212, 214. The speed at which the piston 232 moves through the cylinder 214 is typically the same as the speed at which the piston 230 moves through the cylinder 214. The piston 232 can optionally be similar in structure and function to the piston 32, with an adjustable aperture formed by respective apertures in multiple heads, although a plain piston 232 can be used as is shown here. To alter the relative concentrations or ratio of oil and petrol entering the mixing line, the cylinder 214 and piston 232 can optionally be removed and replaced with another cylinder and piston having a different (e.g. larger) internal diameter. Changing the internal diameter of the cylinder 214 changes the volume of oil 218 delivered to mixing line 254 per stroke of the piston and thereby provides a crude adjustment mechanism in certain circumstances.

In the modified embodiment of dispenser 310 as shown in FIG. 12, having similar features and numbering as the first embodiment but increased by 300, the actuator is optionally adjustable for example by a cam mechanism 320 to change the speed at which one piston, e.g. the second piston 332, moves through the second cylinder 314, relative to the speed at which the first piston 330 moves through the first cylinder 312. Changing the relative speed of the second piston 332 can typically further change the ratio of oil 318 and petrol 316 passing through the non-return valve 360. The cam mechanism 320 typically comprises a cam-shaped plate mounted on a rotational bearing and connected between the lever 322 and connecting rods 340, 342. Rotation of the plate changes the effective force ratio of the lever 322 applied to the connecting rod 342, more than the effective force ratio applied to the connecting rod 340. Thus, rotation of the plate on the cam mechanism asymmetrically changes the amount of force applied to the connector rods 340, 342, causing different forces to be applied to the connector rods 340, 342, by the same movement of the lever 322, and therefore delivering e.g. more force to the connector rod 342 than to connector rod 340, causing a differential in the amount of fluid expelled from the respective cylinders 330, 332, and a differential in the fluid entering the respective supply lines 350, 352, valve 360, mixing line 354 and air bleed valve 362 for delivery in an adjustable ratio through the flashback arrestor 354 to the tank.

FIG. 13 shows a further embodiment of a dispenser, similar to FIG. 1, and using similar numbering, increased by 400. In the FIG. 13 embodiment dispenser 410, the pistons 430 and 432 can be plain as shown or provided with adjustable apertures as previously described. Second cylinder 414 has an optional return flow line 490, 494 that allows some of the oil 418 to vent or escape from the second cylinder 414 and optionally drain to a supply tank (not shown). The amount of oil 418 entering the return flow line 490 is typically controlled by a restrictor 492 in the line 490. As the restrictor 492 is opened, more oil leaks through the return line 490 and the pressure in the oil being urged into the mixing line is reduced, thereby reducing the volume of oil being delivered through the outlet and into the mixing line 454. When the restrictor 492 is closed, the full pressure of the oil in the cylinder 414 is available to urge the oil 418 through the outlet and into the mixing line 454. The line 490 can be provided in the outlet line 452 connected to the outlet of the cylinder 414 as shown, or in the outlet line 450, connected to the outlet of the cylinder 412 containing petrol 416.

The restrictor 492 typically has two relatively rotatable discs with apertures, similar to the piston heads 70, 72 described above. The discs can be rotated relative to one another, like the piston heads 70, 72, to align (and misalign) the apertures in the discs, again as described above. Flow line 494 provides fluid communication between the restrictor 492 and a reservoir of oil (not shown).

Controlling the relative position of the discs (not shown) in the restrictor 492, determines the ratio of petrol 416 and oil 418 entering the mixing line 454. The bypass line 490 and restrictor 492 control the bypass of oil 418 around the piston 432. In an alternative embodiment the restrictor 492 is a valve.

Modifications and improvements can be incorporated without departing from the scope of the invention.

The invention claimed is:

1. A fuel dispenser comprising:

a first cylinder adapted to contain a first fluid, and having an outlet, and a piston movable in the first cylinder and adapted to urge the first fluid through the outlet;

a second cylinder adapted to contain a second fluid and having an outlet, and a piston movable in the second cylinder and adapted to urge the second fluid through the outlet;

a mixing line in fluid communication with the outlet of the first cylinder and with the outlet of the second cylinder; and a flashback arrestor;

wherein at least one of the first and second fluids comprises a fuel, and wherein actuation of the dispenser causes fluid from the first cylinder and fluid from the second cylinder to mix in the mixing line in a proportion of at least 2:1; and wherein the dispenser includes an adjustable aperture that can be adjusted to vary the ratio of fluids within the proportion of at least 2:1, wherein the adjustable aperture is provided in at least one of the first and second pistons.

2. A dispenser according to claim 1, further including a container, the container being in fluid communication with the mixing line, and wherein the flashback arrestor is provided in the container.

3. A dispenser according to claim 1, wherein the flashback arrestor is provided in the mixing line.

4. A dispenser according to claim 1, wherein the dispenser further includes an actuator adapted mechanism adapted to simultaneously move the first piston in the first cylinder and the second piston in the second cylinder, and wherein the actuator adapted mechanism comprises a cam device adjustable to apply a first force to one of the pistons and a second force to the other of the pistons, and wherein the first force is different from the second force.

5. A dispenser according to claim 1, further including at least one non-return valve preventing upstream movement of the first and second fluids after entering the mixing line.

6. A dispenser according to claim 1, wherein at least one of the first and second fluids comprises a fuel additive, selected from the group consisting of lubricants, oils, and octane enhancing additives.

7. A dispenser according to claim 1, wherein the volume of the first cylinder is greater than the volume of the second cylinder.

8. A dispenser according to claim 1, wherein the internal diameter of the first cylinder is larger than the internal diameter of the second cylinder.

9. A dispenser as claimed in claim 1, wherein at least one of the first and second piston has a first and a second piston head, wherein the first and second piston heads are rotatable with respect to one another, and wherein the adjustable aperture is provided in at least one of the first and second piston heads, and is adapted to be adjusted by rotation of at least one of the first and second piston heads relative to the other piston head, wherein adjustment of the aperture changes the size of a fluid conduit through the piston head, allowing the fluid contained in the cylinder between the piston and the outlet to pass through the aperture.

10. A dispenser according to claim 9, wherein each of the first and second piston heads has an aperture adapted to allow passage of fluid through the piston heads when the apertures are in alignment, and wherein at least one of the first and second piston heads has at least one blocking portion adapted to restrict fluid passing through the aperture of the other of the piston heads, when the apertures are not aligned.

11. A dispenser according to claim 1, wherein at least one of the pistons has a first piston head with at least one aperture therein to provide fluid communication through the piston.

12. A dispenser according to claim 11, wherein the piston has a second piston head that has an aperture therein that can be moved into alignment with the aperture in the first piston head, whereby fluid can flow through the aligned apertures.

13. A dispenser according to claim 10, wherein the first piston head has more than one aperture, and wherein the apertures in the first piston head are arranged in a series having different cross-sectional areas permitting different flow rates through the first piston head in accordance with the size of the aperture on the first piston head that is in alignment with the aperture on the second piston head.

14. A dispenser according to claim 1, wherein the dispenser comprises a cam device which is adjustable to move the first and second pistons at different speeds through the cylinders.

15. A method of dispensing at least two fluids from at least two cylinders respectively, at least one of the fluids comprising a fuel, the method including the steps of:

providing a dispenser according to any preceding claim;

filling first and second cylinders of the dispenser with first and second fluids respectively;

moving a first piston in the first cylinder and a second piston in the second cylinder to move fluid from the cylinders into a mixing line;

rotating a first piston head of the first piston relative to a second piston head of the first piston to control the volume of fluid dispensed from the first cylinder;

mixing the fluids in the mixing line; and adjusting an aperture in the dispenser to change the flow characteristics of fluid from at least one of the first and second cylinders.

16. A method of dispensing according to claim 15, wherein the relative rotation of the first and second piston heads changes the alignment of at least one aperture in the first piston head with respect to an aperture of the second piston head.

17. A fuel dispenser comprising:

a first cylinder adapted to contain a first fluid, and having an outlet, and a piston movable in the first cylinder and adapted to urge the first fluid through the outlet;

a second cylinder adapted to contain a second fluid and having an outlet, and a piston movable in the second cylinder and adapted to urge the second fluid through the outlet;

a mixing line in fluid communication with the outlet of the first cylinder and with the outlet of the second cylinder; and a flashback arrestor;

wherein at least one of the first and second fluids comprises a fuel, and wherein actuation of the dispenser causes fluid from the first cylinder and fluid from the second cylinder to mix in the mixing line in a proportion of at least 2:1; and wherein at least one of the first and second cylinders is adapted to be removed and replaced whereby the ratio of the diameters of the first and second cylinders can be adjusted to vary the ratio of fluids within the proportion of at least 2:1.

* * * * *